US007966126B2

(12) United States Patent
Willis et al.

(10) Patent No.: US 7,966,126 B2
(45) Date of Patent: Jun. 21, 2011

(54) VITAL SYSTEM FOR DETERMINING LOCATION AND LOCATION UNCERTAINTY OF A RAILROAD VEHICLE WITH RESPECT TO A PREDETERMINED TRACK MAP USING A GLOBAL POSITIONING SYSTEM AND OTHER DIVERSE SENSORS

(75) Inventors: Sheldon G. Willis, Upper Burrell, PA (US); Robert D. Pascoe, Pittsburgh, PA (US)

(73) Assignee: Ansaldo STS USA, Inc., Pittsburgh, PA (US)

( * ) Notice: Subject to any disclaimer, the term of this patent is extended or adjusted under 35 U.S.C. 154(b) by 797 days.

(21) Appl. No.: 12/031,779

(22) Filed: Feb. 15, 2008

(65) Prior Publication Data

US 2009/0210154 A1 Aug. 20, 2009

(51) Int. Cl.
*G05O 1/00* (2006.01)

(52) U.S. Cl. ..... 701/220; 701/210; 701/214; 340/988; 340/995.25

(58) Field of Classification Search ..... 701/220, 701/210, 214; 340/988, 995.25
See application file for complete search history.

(56) References Cited

U.S. PATENT DOCUMENTS 4,731,613 A 3/1988 Endo et al.
4,790,191 A 12/1988 Shultz, Jr.
4,899,285 A 2/1990 Nakayama et al.
5,129,605 A 7/1992 Burns et al.
5,574,469 A 11/1996 Hsu
5,862,511 A 1/1999 Croyle et al.
5,867,122 A 2/1999 Zahm et al.
5,893,043 A 4/1999 Moehlenbrink et al.
5,902,351 A 5/1999 Streit et al.
5,948,043 A 9/1999 Mathis
6,127,970 A 10/2000 Lin
6,128,558 A 10/2000 Kernwein
6,218,961 B1 4/2001 Gross et al.
6,317,688 B1 11/2001 Bruckner et al.
6,345,233 B1 2/2002 Erick
6,373,403 B1 4/2002 Korver et al.
6,397,130 B1 5/2002 Carr et al.
6,434,452 B1 8/2002 Gray
6,449,559 B2 9/2002 Lin
6,456,937 B1 9/2002 Doner et al.
6,480,766 B2 11/2002 Hawthorne et al.
6,496,778 B1 12/2002 Lin
6,641,090 B2 11/2003 Meyer
6,681,160 B2 1/2004 Bidaud
6,826,478 B2 11/2004 Riewe et al.
6,879,875 B1 4/2005 Hu et al.
(Continued)

*Primary Examiner* — Mark Hellner
(74) *Attorney, Agent, or Firm* — Eckert Seamans Cherin & Mellott, LLC; Kirk D. Houser, Esquire

(57) ABSTRACT

A system includes a global positioning system receiver to determine position of a railroad vehicle, a predetermined track map of possible coordinates of the vehicle, motion sensors providing a positive bias error to determine change in location of the vehicle, an acceleration sensor to determine acceleration of the vehicle, and a processor to vitally determine the location and the location uncertainty of the vehicle on the track map. The processor verifies one motion sensor with another motion sensor, determines a slip or slide condition of the vehicle from one of the motion sensors, determines speed and position of the vehicle from the acceleration sensor during the slip or slide condition, verifies the position of the vehicle from the global positioning system receiver based upon the track map, and corrects the positive bias error of the motion sensors using the position of the vehicle from the global positioning system receiver.

27 Claims, 4 Drawing Sheets

U.S. PATENT DOCUMENTS

| | | | | |
|---|---|---|---|---|
| 6,970,774 | B2 | 11/2005 | Kane et al. | |
| 7,200,471 | B2 | 4/2007 | Kane et al. | |
| 2002/0045975 | A1 | 4/2002 | Carr et al. | |
| 2002/0062193 | A1 | 5/2002 | Lin | |
| 2003/0216865 | A1* | 11/2003 | Riewe et al. | 701/220 |
| 2003/0236598 | A1 | 12/2003 | Villarreal Antelo et al. | |
| 2004/0267450 | A1 | 12/2004 | Kernwein | |
| 2005/0065726 | A1 | 3/2005 | Meyer et al. | |
| 2005/0107954 | A1 | 5/2005 | Nahla | |
| 2006/0030978 | A1 | 2/2006 | Rajaram | |
| 2007/0010940 | A1* | 1/2007 | Tan et al. | 701/207 |
| 2009/0138199 | A1* | 5/2009 | Bonanni et al. | 701/214 |

* cited by examiner

VITAL SYSTEM FOR DETERMINING LOCATION AND LOCATION UNCERTAINTY OF A RAILROAD VEHICLE WITH RESPECT TO A PREDETERMINED TRACK MAP USING A GLOBAL POSITIONING SYSTEM AND OTHER DIVERSE SENSORS

BACKGROUND OF THE INVENTION

1. Field of the Invention

This invention pertains generally to systems for determining location and, more particularly, to systems for determining location and location uncertainty of railroad vehicles.

2. Background Information

In the art of railway signaling, traffic flow through signaled territory is typically directed by various signal aspects appearing on wayside indicators or cab signal units located on-board railway vehicles. The vehicle operators recognize each such aspect as indicating a particular operating condition allowed at that time. Typical practice is for the aspects to indicate prevailing speed conditions.

For operation of this signaling scheme, the track is typically divided into cascaded sections known as "blocks." These blocks, which may be generally as long as about two to about five miles in length, are electrically isolated from adjacent blocks by typically utilizing interposing insulated joints. When a block is unoccupied, track circuit apparatus connected at each end are able to transmit signals back and forth through the rails within the block. Such signals may be coded to contain control data enhancing the signaling operation. Track circuits operating in this manner are referred to as "coded track circuits." One such coded track circuit is illustrated in U.S. Pat. No. 4,619,425. When a block is occupied by a railway vehicle, shunt paths are created across the rails by the vehicle wheel and axle sets. While this interrupts the flow of information between respective ends of the block, the presence of the vehicle can be positively detected.

In the case of trains, control commands change the aspects of signal lights, which indicate how trains should move forward (e.g., continue at speed; reduce speed; stop), and the positions of switches (i.e., normal or reverse), which determine the specific tracks the trains will run on. In dark (unsignaled) territory, forward movement of trains is specified in terms of mileposts (e.g., a train is given the authority to move from its current location to a particular milepost along its planned route), landmarks or geographic locations. Sending the control commands to the field is done by an automated traffic control system, or simply control system. Control systems are employed by railroads to control the movements of trains on their individual properties or track infrastructures. Variously known as Computer-Aided Dispatching (CAD) systems, Operations Control Systems (OCS), Network Management Centers (NMC) and Central Traffic Control (CTC) systems, such systems automate the process of controlling the movements of trains traveling across a track infrastructure, whether it involves traditional fixed block control or moving block control assisted by a positive train control system.

In dark territory, controlling the movements of trains is effected through voice communication between a human operator monitoring the control system and the locomotive engineer. The interface between the control system and the field devices can either be through control lines that communicate with electronic controllers at the wayside that in turn connect directly to the field devices, or, in dark territory, through voice communication with a human, who manually performs the state-changing actions (e.g., usually switch throws).

It is known to employ a Global Positioning System (GPS) to determine the position of a train. For example, U.S. Pat. No. 4,899,285 discloses a system in which measurement results of a GPS position measuring apparatus are evaluated to determine whether they are reliable with respect to those derived by an integration calculation position measuring apparatus. The integration apparatus includes a direction sensor using a gyroscope or geomagnetic sensor and a vehicle speed sensor. Three GPS positions are sequentially measured, which correspond to three positions measured by the integration apparatus. The integration apparatus determines whether the measurement results of the GPS apparatus are twice continuously highly reliable. If so, then the integration apparatus adopts the subsequently measured GPS result as the reference position and executes the subsequent measurement of the position of the vehicle.

U.S. Pat. No. 5,129,605 discloses a wheel tachometer that generates pulses for a dead reckoning filter of a train control computer (TCC) to determine speed. The TCC compares velocity and position data, and rejects inconsistent data. A GPS receiver also generates a speed and position signal, which is input to the TCC to indicate position and speed, and also to calibrate the wheel tachometer. The TCC determines the best source of the speed signals. In making such determinations, the GPS speed is generally preferred when it is greater than ten miles per hour or when wheel slip is detected; otherwise, GPS calibrated wheel tachometer speed is used.

U.S. Patent Application Publication No. 2005/0065726 discloses that inertial sensors are subject to low frequency bias and random walk errors. Such errors grow in an unbounded manner upon integrating accelerometer and gyro output signals to obtain velocity and position, i.e., the computation has poor long-term stability. These long-term errors are corrected for by blending with D/GPS data, which possess comparatively excellent long-term stability. Conversely, a conventional navigator solution possesses good short-term stability, as the integration process tends to smooth high-frequency sensor errors (which are usually attenuated significantly by low-pass filtering), while D/GPS data has comparatively poor short-term stability due to, for example, multipath effects and broadband noise. A train location system and method of determining track occupancy utilizes inertial measurement inputs, including orthogonal acceleration inputs and turn rate information, in combination with wheel-mounted tachometer information and GPS/DGPS position fixes to provide processed outputs indicative of track occupancy, position, direction of travel and velocity. Various navigation solutions are combined together to provide the desired information outputs using a Kalman filter or similar Bayesian estimator.

U.S. Pat. No. 5,902,351 discloses a vehicle tracking system including an inertial measurement unit having at least one gyro and at least one accelerometer, an odometer/tachometer, a GPS receiver, a tag receiver, and a map matching system. A Kalman filter may be utilized to reduce error within the vehicle tracking system and improve the accuracy thereof.

U.S. Pat. No. 5,893,043 discloses a process and an arrangement for determining the position of a vehicle moving on a given track by using a map matching process. At least three types of position measuring data in the form of object site data, path length data and route course data are obtained. A computer unit carries out, for each type of measuring data, a data correlation with a stored desired data quantity for the determination of position results, which are evaluated in an "m-out-of-n" decision making process. In this process, a given number "m" of the "n" determined position results is taken into account.

There is room for improvement in systems for determining location and location uncertainty of railroad vehicles.

SUMMARY OF THE INVENTION

This need and others are met by embodiments of the invention, which provide a vital system for determining location and location uncertainty of a railroad vehicle using a global positioning system receiver to determine position of the railroad vehicle, a predetermined track map of possible coordinates of the railroad vehicle, a plurality of motion sensors structured to determine change in location of the railroad vehicle, the motion sensors being biased to provide a positive bias error of the change in location of the railroad vehicle, and an acceleration sensor structured to determine acceleration of the railroad vehicle.

In accordance with an aspect of the invention, a system is for determining location and location uncertainty of a railroad vehicle. The system comprises: a global positioning system receiver structured to determine position of the railroad vehicle; a predetermined track map of possible coordinates of the railroad vehicle; a plurality of motion sensors structured to determine change in location of the railroad vehicle, the motion sensors being biased to provide a positive bias error of the change in location of the railroad vehicle; an acceleration sensor structured to determine acceleration of the railroad vehicle; and a processor cooperating with the global positioning system receiver, the predetermined track map, the motion sensors and the acceleration sensor to vitally determine the location and the location uncertainty of the railroad vehicle on the predetermined track map, the processor being structured to verify one of the motion sensors with another one of the motion sensors, determine a slip or slide condition of the railroad vehicle from the one of the motion sensors, determine speed and position of the railroad vehicle from the acceleration sensor during the slip or slide condition, verify the position of the railroad vehicle from the global positioning system receiver based upon the predetermined track map, and correct the positive bias error of the one of the motion sensors using the position of the railroad vehicle from the global positioning system receiver.

The processor may be structured to determine the location and the location uncertainty of the railroad vehicle in each of a plurality of periodic cycles.

The processor may be further structured to determine a tracking error from the difference between: (a) the position of the railroad vehicle from the global positioning system receiver for the current one of the periodic cycles, and (b) the location of the railroad vehicle for the previous one of the periodic cycles.

The processor may be further structured to determine the location uncertainty of the railroad vehicle in each of the periodic cycles; the processor may be further structured to determine the location uncertainty of the railroad vehicle for the current one of the periodic cycles from the sum of: (a) the location uncertainty of the railroad vehicle for the previous one of the periodic cycles, and (b) a predetermined constant times the change in location of the railroad vehicle from the one of the motion sensors; the track map may include a representation of a track for the railroad vehicle; the position of the railroad vehicle from the global positioning system receiver may have an uncertainty; the processor may be further structured to determine the tracking error only after the position of the railroad vehicle from the global positioning system receiver for a consecutive plurality of the periodic cycles satisfies both of: (a) a first condition defined by the position of the railroad vehicle from the global positioning system receiver as projected on the representation of a track being within: (i) a lower limit of the location of the railroad vehicle for the previous one of the periodic cycles minus the location uncertainty of the railroad vehicle for the current one of the periodic cycles, and (ii) an upper limit of the location of the railroad vehicle for the previous one of the periodic cycles plus three times the uncertainty of the global positioning system receiver along the representation of a track, and (b) a second condition defined by the position of the railroad vehicle from the global positioning system receiver as measured orthogonal to the representation of a track being within: (i) a lower limit of the location of the railroad vehicle for the previous one of the periodic cycles minus three times the uncertainty of the global positioning system receiver, and (ii) an upper limit of the location of the railroad vehicle for the previous one of the periodic cycles plus three times the uncertainty of the global positioning system receiver.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the term "processor" means a programmable analog and/or digital device that can store, retrieve, and process data; a computer; a workstation; a personal computer; a microprocessor; a microcontroller; a microcomputer; a central processing unit; a mainframe computer; a mini-computer; a server; a networked processor; an on-board computer; or any suitable processing device or apparatus.

As employed herein, the term "vital" or "vitally" means that the acceptable probability of a hazardous event resulting from an abnormal outcome associated with a corresponding activity or thing is less than about $10^{-9}$/hour. Alternatively, the mean time between hazardous events is greater than $10^{9}$ hours. Static data used by vital routines (algorithms), including, for example, track map data, have been validated by a suitably rigorous process under the supervision of suitably responsible parties.

As employed herein, the terms "railroad" or "railroad service" mean freight trains or freight rail service, passenger trains or passenger rail service, transit rail service, and commuter railroad traffic, commuter trains or commuter rail service.

As employed herein, the term "railroad vehicle" means freight trains, passenger trains, transit trains and commuter trains, or a number of cars of such trains or of a railroad consist.

As employed herein, the terms "carborne" and "carborne equipment" refer to things or equipment on-board a railroad vehicle.

The invention is described in association with a positive train control system, although the invention is applicable to a wide range of systems for determining the location and the location uncertainty of a railroad vehicle.

Figure 1:
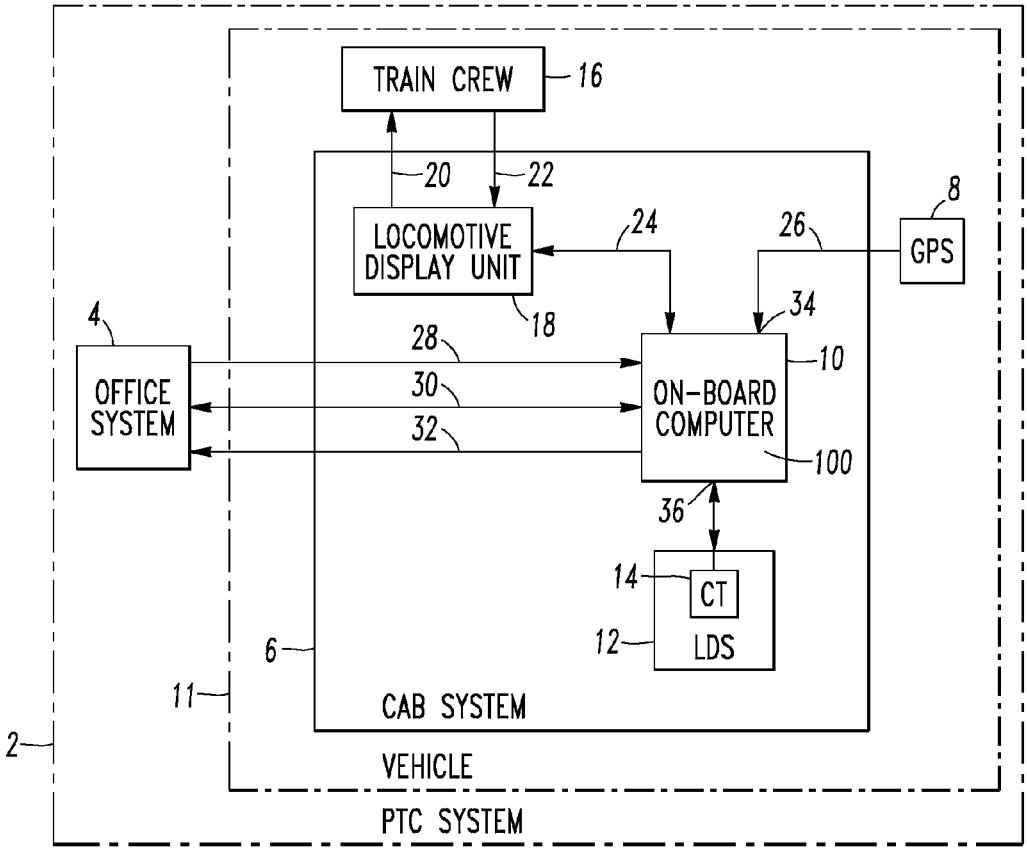
FIG. 1 is a block diagram of a positive train control (PTC) system in accordance with embodiments of the invention.

Referring to FIG. 1, a positive train control (PTC) system 2 includes an office system 4 and a carborne navigation system, such as the example CAB system 6 having a global positioning system (GPS) receiver 8. The GPS receiver 8 is, for example, a data radio mounted near a processor, such as the example on-board computer (OBC) 10. The GPS receiver 8 provides local geographic coordinates of an object, such as the example railroad vehicle (e.g., without limitation, train 11) (shown in phantom line drawing). The OBC 10 includes a location determining system (LDS) 12 having a coordinate transformation (CT) subsystem 14. A train crew 16 interfaces to the OBC 10 through a locomotive display unit (LDU) 18, which provides train status alerts 20 to and receives operator input 22 from the train crew 16. The LDU 18 also communicates data 24 to and from the OBC 10. The OBC 10 receives DGPS location inputs 26 from the GPS receiver 8. The GPS location can be expressed in a specific coordinate system (e.g., without limitation, latitude/longitude, using the WGS 84 geodetic datum or a suitable local system specific to a corresponding country). The office system 4 is, for example, a computer aided dispatch (CAD) system, which controls, at least, all of the railroad vehicles (one railroad vehicle 11 is shown in phantom line drawing) on a particular railroad line (not shown). The OBC 10 of the CAB system 6 has vital control of the railroad vehicle 11 and monitors the safe operation of the railroad vehicle 11 by the train crew 16. However, not all of the CAB system 6 needs to be vital. For example, the example locomotive display unit 18 is not vital. The OBC 10 can have both vital and non-vital functions. The OBC 10 receives track authorities and speed restrictions 28 from the office system 4, communicates alerts 30 to and from the office system 4, and outputs location reports 32 as well as confirmations of consist changes, power changes, switch positions and authorities to the office system 4.

Figure 2:
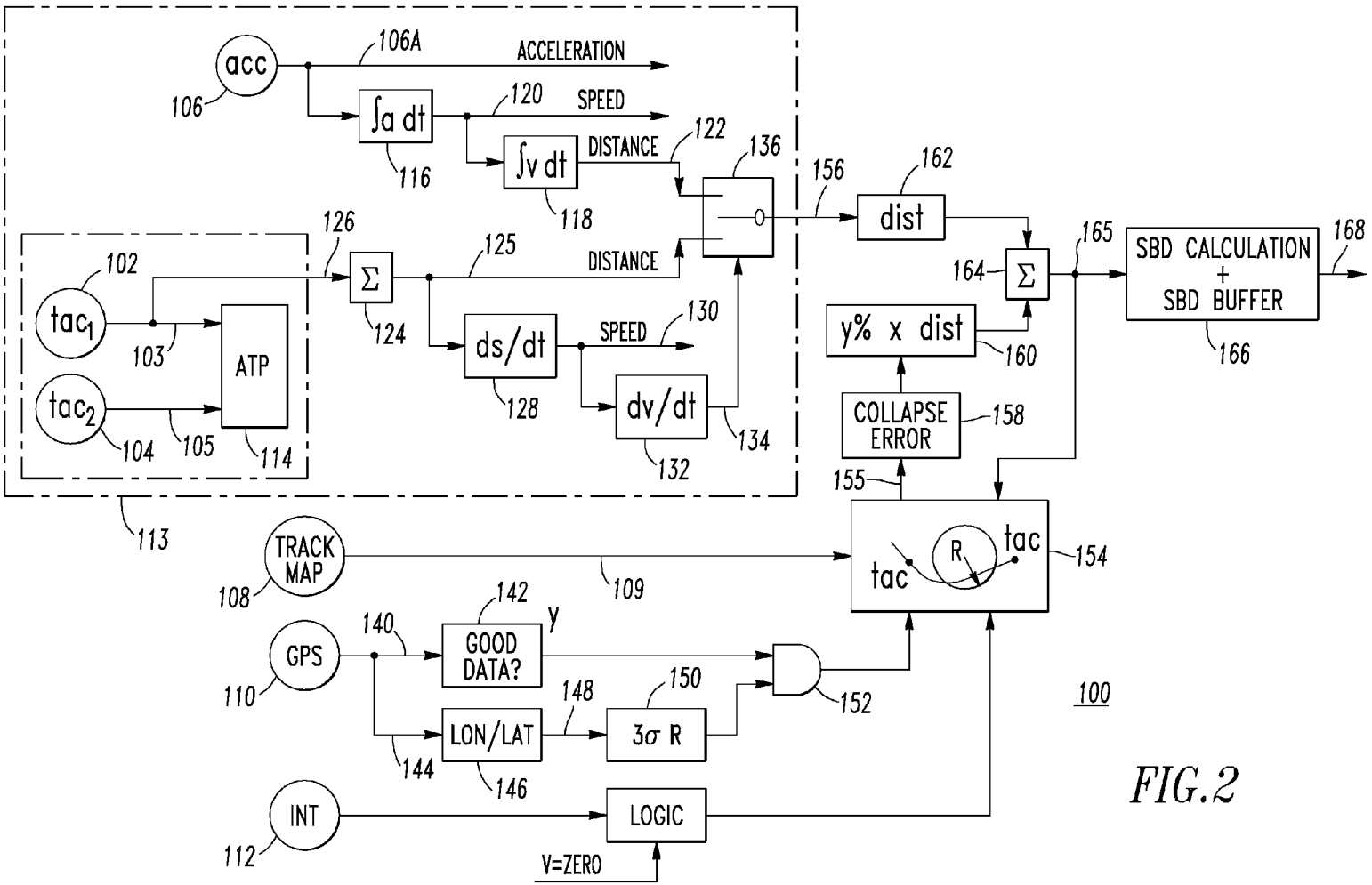
FIG. 2 is a block diagram of a routine executed by the on-board computer of FIG. 1 for determining location and location uncertainty of a railroad vehicle with respect to a predetermined track map using a global positioning system (GPS), two tachometers and an accelerometer.

The LDS 100 of FIG. 2 may the same as or similar to the LDS 12 of FIG. 1. The LDS 100 combines various sensor readings to determine location of a railroad vehicle, such as 11 (FIGS. 1 and 3), on a track 101 (FIG. 3) and a location uncertainty for safe braking distance (SBD) calculations. The LDS 100 is useful for any navigation system for railroad carborne application systems. The LDS 100 inputs include two active tachometers 102,104, each of which is mounted on a corresponding axle (not shown) of the railroad vehicle 11 and measures the speed of that axle. A linear accelerometer 106, which is mounted in or near the OBC 10 (FIG. 1), measures the linear acceleration 106A of the railroad vehicle 11. A digital track map 108 is stored in the OBC 10 and employs local track mapped coordinates as opposed to the GPS local geographic coordinates. The GPS receiver 110, which is in a data radio (not shown) mounted near the OBC 10, provides the GPS local geographic coordinates of the railroad vehicle 11. The initial input 112 (Int) is provided by the user to verify that the initial railroad vehicle position is, in fact, correct.

The block 113 of the LDS 100 is conventional and is used by conventional CAB signaling systems. The outputs 103, 105 of the two respective tachometers 102,104 are input by an automatic train protection (ATP) system 114, as is also conventional. One of the tachometers 102,104 is a backup to and checks the other tachometer. Also, the accelerometer 106 is used to measure speed in conventional CAB signaling systems during slip/slide conditions. An acceleration function 116 and rate numerical integration function 118 calculate the corresponding speed (rate) 120 and distance (position) 122 of the railroad vehicle 11. The tachometer summation function 124 is an integration block that counts the pulses of the tachometer 102. The tachometer 102 is compared to the other tachometer 104 and is only used if they are within a suitable tolerance of each other. For example, the tachometer 102 outputs position change pulses 126 into the summation function 124. A ds/dt function 128 calculates speed 130 from the count of tachometer pulses divided by the sample time of the counting process. A dv/dt function 132 calculates the acceleration (speed changes) 134 over a relatively short time period. A selector function 136 checks the acceleration 134 against physical limits to determine if the tachometers 102, 104 are slipping or sliding. If any slip or slide occurs, then the accelerometer 106 is used to calculate speed 120 and distance 122.

Known devices used for calculating distance are the tachometers 102,104 and the accelerometer 106. One tachometer 102 is the main device, while the other tachometer 104 is the secondary device. Two tachometer-indicated speeds 130 (only one is shown (e.g., V1); the second speed (e.g., V2) is used to validate the first speed (e.g., V1)) are compared (e.g., $\Delta V = V1 - V2$) to ensure that they are within a predetermined speed range (e.g., without limitation, $\Delta V < 2$ mph). Otherwise, if the change is higher than the predetermined value, then the train 11 is slipping, the tachometers 102,104 are not used to calculate speed 130 and distance 125, and the accelerometer 106 is used to determine the speed 120 and the distance 122. If slip/slide is detected by dv/dt function 134 and selector function 136, then the accelerometer 106 is used to calculate distance 122 during the slip/slide detection period.

The LDS 100 has a suite of sensors for estimating location, and takes advantage of the fact that the sensors are diverse and, thus, have different error characteristics. The tachometers 102,104 measure wheel rotation. The tachometer signal output 103,105 is pulses processed as a function of feet per pulse and wheel diameter (feet) to output distance traveled (feet). "Delta" distances accumulate to calculate the distance traveled. The wheel diameter entered into the LDS 100 is always rounded up and is periodically calibrated (e.g., without limitation, every 90 days). The entered wheel diameter used in the distance traveled calculations will always be greater than the actual wheel diameter. The wheel diameter "always greater" effect causes a predictable positive accumulated error in the distance traveled. Over time, as the wheel wears, the gain of the positive error increases. The error exhibits itself as percentage of distance traveled. The positive error is the dominant error over the relatively low random noise in the tachometers 102,104. The speed 130 is calculated from the distance traveled divided by the cycle time. The delta distance observation used is the highest delta distance of the two tachometers 102,104. Each cycle, the greater of the two distance traveled tachometer measurements is used as the input to the location update (Equation 6, below) variable $L_{Tach(N)}$. Cross checking the two tachometers 102,104 before using their outputs provides an increased level of safety.

Figure 3:
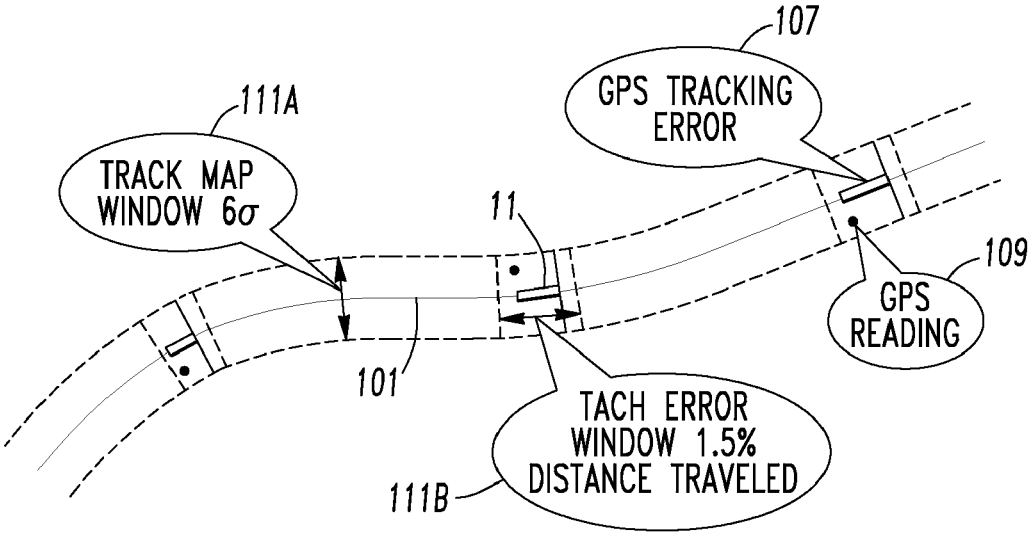
FIG. 3 is a representation of a portion of a track map showing a track map window, a tachometer error window, a GPS tracking error and the GPS position of a train.

The inertial accelerometer 106 measures linear acceleration along the direction of travel plus a gravity component as a function of grade of the track 101 (FIG. 3). The accelerometer 106 is used for speed 120 and distance 122 calculations during slip/slide conditions. Slip/slide conditions will cause the tachometer speed 130 changes to be higher than physically possible by the train 11. Accelerometer noise and other bias errors are negligible when using the accelerometer 106 for short slip/slide time spans. The bias errors becomes significant with longer time spans.

The GPS 110 calculates position from satellites orbiting the earth. The GPS position readings are used for initialization and corrections to the tachometer error in the LDS 100. As a non-limiting example, GPS position readings are received, for example, with about a one to two second delay. If the GPS receiver 110 gets a differential signal from a nearby base station, then the accuracy level increases. Differential lock and horizontal dilution of precision (HDOP) signals qualify the GPS data 144.

Differential lock is a flag from the GPS receiver 110, which flag sets the GPS uncertainty. One uncertainty is for non-differential GPS and a smaller uncertainty is for the GPS differential mode.

Dilution of precision (DOP) describes the geometric strength of a satellite configuration on GPS accuracy. When visible satellites are close together in the sky, the geometry is said to be weak and the DOP value is high; when far apart, the geometry is strong and the DOP value is low. Thus, a low HDOP value represents a better GPS horizontal positional accuracy due to the wider angular separation between the satellites used to calculate a GPS unit's position.

The uncertainty in the GPS readings is presumed to be seven feet for differential lock and 18 feet without. The HDOP affects the GPS uncertainty. A maximum HDOP is used to qualify the GPS data 144. Any readings above the HDOP are not used in the location calculations. The HDOP that corresponds to the final uncertainty chosen is used as criteria for rejecting GPS data 144. If a false differential lock is received, then the smaller uncertainty window will reject the GPS data 144 with a larger error.

The GPS 110 includes different internal modes, which output status data 140. A good data function 142 checks the GPS output status data 140 to determine if the GPS data 144 can be used. A Lon/Lat function 146, which may be the same as or similar to the CT subsystem 14 of FIG. 1, converts the latitude and longitude of the GPS data 144 (GPS local geographic coordinates) into the local track mapped coordinates 148. A 3σ R function 150 checks the distance between the local track mapped coordinates 148 and the actual track coordinates from the track map 108. This check is used to verify that the GPS data 144 is good. If it is, then the GPS data 144 can be used to calculate a GPS tracking error 107 (FIG. 3; Equation 1A). Otherwise, the GPS tracking error 107 is set to 0 (Equation 1B). An AND function 152 checks for the two conditions of the GPS data 144 being good, as determined by the good data function 142, and the distance between the local track mapped coordinates 148 and the actual track coordinates from the track map 108 being within 3σ, as will be described.

The 3σ R function 150 projects the GPS reading on the track map 108 to determine the GPS tracking error 107. The variable σ is the GPS position uncertainty or $\sigma_{GPS}$. The graphical function 154 shows graphically how the local track mapped coordinates 148 relate to the track map 108. If the output of the AND function 152 is true, then a GPS correction 155 is applied to the current position 156, as will be discussed. The collapse error function 158 and y % x dist function 160 show that the GPS correction 155 is applied to the current position 156, in order to correct tachometer distance error build up. The functions 160,162,164 can be determined by Equations 6 or 7 (for slip/slide conditions), below, as will be discussed. The Safe Braking Distance (SBD) calculation and SBD buffer 166 are part of the ATP system 114, which add any distances and/or position uncertainties to the location. The output 168 is the reported position of the railroad vehicle 11 and its uncertainty level. The LDS output 165 includes the distance and the speed of the railroad vehicle 11. The distance (position), as output by the LDS 100 at 165, is input and used by the SBD calculations 166 for the ATP system 114.

The track map 108 serves as a vital check to reject false GPS readings. The calculated location of the railroad vehicle 11 is always assumed to be on the track coordinates. The purpose of the GPS 110 is to "collapse" the accumulated distance error caused by the tachometers 102,104 and provide an initial position. The accumulated distance error is reduced with the lower limit being the uncertainty of the GPS position readings. The dominant predictable wheel diameter error characteristics provide a window for rejecting false GPS position readings in the direction of the track 101 (FIG. 3). Qualifying and validating the GPS data 144 is done with a rejection error window 111A (FIG. 3). The GPS data 144 that is off the track 101 (e.g., >3σ in a direction normal to the track 101) and, also, outside an accumulated error window 111B (FIG. 3) is rejected. As shown in FIG. 3, the effect of error in estimated location, as calculated, "grows" as a percentage of the total distance calculated (e.g., 1.5% of the total distance calculated).

The location accumulated error can only be corrected to the GPS uncertainty, since the GPS 110 serves as the initial location reference. As the distance traveled increases, eventually the accumulated error window 111B will be larger than the mean GPS tracking error 107 (i.e., estimated location perpendicular to the track minus the GPS position 109 projected on the track 101). When the GPS tracking error 107 is less than the accumulated error window for a number of consecutive readings, then the GPS tracking error 107 (Equations 1A, 1B and 2, below) corrects the location. A portion of the GPS tracking error 107 reduces the location uncertainty (Equations 9 and 10). The full GPS tracking error 107 is applied to the location estimate in Equation 6.

The LDS 100 includes a location update (Equations 6 or 7, below) and an uncertainty update (Equations 8A, 8B-8C, 9 or 10, below). The GPS corrections (location update) and uncertainty updates occur, for example, every second.

The location update of Equation 6 includes accumulating pulses from the highest output of the two tachometers 102, 104 and applying the GPS tracking error 107 correction (Equations 1A or 1B, below). Crosschecks with both tachometers 102,104 verify the tachometer measurements. As a precondition to Equation 1A, the GPS tracking error 107 is checked to be within $3\sigma_{GPS}$ (three times the GPS uncertainty) of the track map 108 and within a location uncertainty window (Equations 8A or 8B-8C, below) along the direction of the track for six consecutive readings. If so, then the probability of the GPS position being not correct is about $(1\text{-}0.989)^6$ (wherein the number 0.989 comes from the probability that a reading is within 3 sigma of its correct value) or about $1.77\times10^{-12}$. The most significant error is the accumulated positive bias error in the tachometers 102,104. The random noise error of the tachometers 102,104 is small relative to the GPS position error; therefore, the GPS tracking error 107 (Equation 1A) has the same noise characteristics as the GPS position, but with the mean removed for short time periods.

Figure 4:
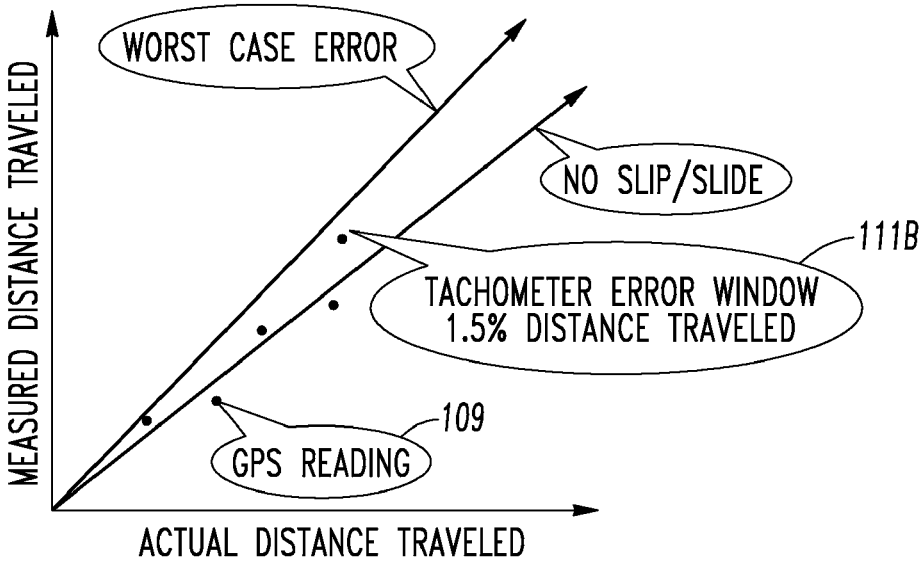
FIG. 4 is a plot of actual distance versus measured distance traveled by a train for no slip/slide errors, a worst case error and various GPS readings.

FIG. 4 shows actual distance traveled versus measured distance traveled.

The estimated location (Equations 6 or 7, below) is updated, for example, every second by incrementing the estimated location of the previous cycle ($L_{(N-1)}$) with the tachometer distance ($L_{Tach(N)}$) (Equation 6). A cross check between the two tachometer readings validates that the two tachometer speed measurements agree to within, for example, ±2 mph for the speed 130 (FIG. 2) to be valid. If a slip/slide condition has been detected by the selector function 136 (FIG. 2), then the location change is calculated (Equation 7) using the last known good speed 120 ($V_{(N-1)}$) and the speed change ($\alpha_{Decel(N)}*C_t$) from the accelerometer 106 (FIG. 2). The GPS position (local track mapped coordinates 148 (FIG. 2)) is received, for example, every second with a one to two second delay relative to the tachometer readings. In Equation 6 or Equation 7, a GPS position correction is applied from Equation 1A if certain preconditions are met. The GPS tracking error 107 (Equation 1A) is calculated from the GPS position less the delayed estimated location of the previous cycle.

The location estimate uncertainty ($LU_{W(N)}$ or $LU_{WP(N)}$) is the uncertainty of the previous cycle ($LU_{W(N-1)}$ or $LU_{WP(N-1)}$) plus the accumulated tachometer error due to distance traveled ($K_2*L_{Tach(N)}$) minus the GPS tracking error correction ($0.2*|L_{GPSTrackErr(N)}|$). See Equations 8A and 9, below.

The uncertainty of the estimated location 165 (FIG. 2) is bounded to keep the safety buffer from growing too large. If the uncertainty grows too large, then the railroad vehicle 11 will be required to stop. The number is defined, for example, by a suitable safety case analysis for the particular railroad project. The presence of the GPS differential lock signal sets the expected GPS uncertainty ($\sigma_{GPS}$) to 7 feet; otherwise, it is 18 feet. For speeds above 10 mph, the GPS differential lock signal is ignored and the location uncertainty window lower limit is forced to 54 feet ($3\sigma_{GPS}$). The GPS uncertainty includes any GPS random bias error effects. The GPS tracking error 107 trends toward the accumulated (GPS and tachometer) error plus any residual error from the last GPS position update.

The 1.5% accuracy of the tachometers 102,104 for short distances and the track map 108 with $3\sigma_{GPS}$ window establish the confidence level of the GPS position. As shown in FIG. 3, the track map 108 (FIG. 2) has the window 111A for rejecting GPS position readings perpendicular to the track 101 (FIG. 3) and the tachometer accuracy window 111B (FIG. 3) for rejecting GPS position readings inline with the track 101, in order to check the GPS validity.

The GPS uncertainty ($\sigma_{GPS}$) is kept by requiring, for example, the six previous GPS readings to be inside the track map window 111A ($3\sigma_{GPS}$) and the location uncertainty window 111B (Equations 8A and 9).

The following variables are used in Equations 1-12, below:

$L_{(N)}$ is location estimate in map coordinates resolved to 7-foot fragments as part of blocklets; this location estimate is updated every cycle by the tachometer position change and GPS corrections, if available.

$L_{Tach(N)}$ is tachometer position "delta" or the change in location measured each cycle from the highest output of the two tachometers 102,104.

$L_{GPS(N)}$ is GPS location projected onto the track 101.

L_hd GPSTrackErr(N) is GPS tracking error 107.

$\alpha_{Decel(N)}$ is the measurement of the accelerometer 106.

$K_2$ is location bias error coefficient (e.g., without limitation, 0.015) of the tachometers 102,104.

$K_3$ is location bias error coefficient (e.g., without limitation, 0.05) of the accelerometer 106.

$V_{Slip/Slide}$ is slip/slide velocity change limit.

$LU_{W(N)}$ is location uncertainty window, which is initialized to 3σGPS $LU_{WP(N)}$ is location uncertainty window positive side (the window grows asymmetrically for tachometer errors; during slip/slide, the uncertainty grows in both directions), which is initialized to $3\sigma_{GPS}$. During non-slip/slide conditions, the uncertainty increases in the positive direction only due to the tachometer wheel diameter bias. During slip/slide conditions, the uncertainty increases equally in both directions.

$\sigma_{GPS}$ is GPS uncertainty (e.g., without limitation, 7 feet; 18 feet for non-differential).

$C_t$ is sample time (e.g., without limitation, 1 second).

N-1 is the previous cycle number.

N is the current cycle number.

$V_{(N-1)}$ is velocity of the previous cycle.

$V_{(N)}$ is velocity of the current cycle.

Equation 1A is evaluated if the following three conditions are true: (1) the last six GPS readings are in the window: $L_{(N-1)}-LU_{W(N)}<$GPS reading projected on the track map 108$<L_{(N-1)}+3\sigma_{GPS}$ along the track 101; (2) $L_{(N-1)}-3\sigma_{GPS}<$GPS reading projected on the track map 108$<L_{(N-1)}+3\sigma_{GPS}$ orthogonal to the track 101; and (3) the qualifier window is affected in the positive direction during slip/slide conditions:

$$L_{(N-1)}-LU_{W(N)}<\text{GPS reading}<L_{(N-1)}+LU_{WP(N)}\text{, then: } L_{GPSTrackErr(N)}=L_{GPS(N)}-L_{(N-1)} \quad \text{(Eq. 1A)}$$

else, Equation 1B is evaluated:

$$L_{GPSTrackErr(N)}=0 \quad \text{(Eq. 1B)}$$

In normal steady state conditions, the GPS tracking error 107 can be positive or negative, although it may be more negative than positive for certain periods of time.

The GPS tracking error limit is shown by Equation 2:

$$-|L_{GPSTrackErrLim(N)}|\leq L_{GPSTrackErr(N)}\leq |L_{GPSTrackErrLim(N)}| \quad \text{(Eq. 2)}$$

wherein:

$L_{GPSTrackErrLim(N)}=L_{Tach(N)}$ and $L_{GPSTrackErrLim(N)}$ is always greater than 20 (feet per cycle).

Hence, for computing the limits, a lower limit on the check is set to 20 feet per cycle.

Equation 3 provides a slip/slide condition check.

$$V_{(N)}-V_{(N-1)}>V_{Slip/Slide} \quad \text{(Eq. 3)}$$

If slip/slide exists, then Equation 4 sets the velocity $V_{(N)}$.

$$V_{(N)}=V_{(N-1)}+\alpha_{Decel(N)}*C_t \quad \text{(Eq. 4)}$$

Otherwise, Equation 5 sets the velocity for non-slide conditions.

$$V_{(N)}=L_{Tach(N)}/C_t \quad \text{(Eq. 5)}$$

Equations 6 and 7 update the location for non-slide and slide conditions, respectively. The tachometer data is combined with the GPS data in Equation 6. This position update corrects the position for accumulated tachometer error. This equation essentially is the collapse error function 158 of FIG. 2. The error is continuously collapsed as long as GPS data 144 is received and the GPS data 144 is good (FIG. 2).

$$L_{(N)}=L_{(N-1)}+L_{Tach(N)}+L_{GPSTrackErr(N)} \quad \text{(Eq. 6)}$$

$$L_{(N)}=L_{(N-1)}+V_{(N-1)}*C_t+\alpha_{Decel(N)}*C_t^2/2+L_{GPSTrackErr(N)} \quad \text{(Eq. 7)}$$

In Equations 8A-8C, for the location uncertainty window update, only one of $K_2$ or $K_3$ is used at one time; $K_2$ is set to zero for slip/slide conditions and, otherwise, $K_3$ is set to zero. If the GPS reading is out of the window defined by the three conditions for Equation 1A, then either Equation 8A is used for non-slide conditions or Equations 8B-8C are used for slide conditions. The bounded error characteristics of the tachometers 102,104 are used to qualify the GPS data. In particular, the integrated tachometer pulses are used to calculate the window to reject GPS readings along the direction of the track 101 in Equation 8A.

$$LU_{W(N)}=LU_{W(N-1)}+K_2*L_{Tach(N)} \quad \text{(Eq. 8A)}$$

$$LU_{W(N)}=LU_{W(N-1)}+K_3*|L_{(N)}-L_{(N-1)}| \quad \text{(Eq. 8B)}$$

$$LU_{WP(N)}=LU_{WP(N-1)}+K_3*|L_{(N)}-L_{(N-1)}| \quad \text{(Eq. 8C)}$$

If the GPS reading is in the window defined by the three conditions for Equation 1A for at least the last six readings, then Equation 9 applies for non-slide conditions and Equation 10 applies for slide conditions.

$$LU_{W(N)}=LU_{W(N)}-0.2*|L_{GPSTrackErr(N)}| \quad \text{(Eq. 9)}$$

$$LU_{WP(N)}=LU_{WP(N)}-0.2*|L_{GPSTrackErr(N)}| \quad \text{(Eq. 10)}$$

Equations 11 and 12 provide the uncertainty low limit for slide conditions. Lower limits on the uncertainty windows are evaluated every cycle. If the value calculated is lower, then the value is set to the lower limit.

$$\text{If } LU_{W(N)} \leqq 3*\sigma_{GPS}, \text{ then } LU_{W(N)} \text{ is set to } 3*\sigma_{GPS} \quad \text{(Eq. 11)}$$

$$\text{If } LU_{WP(N)} \leqq 3*\sigma_{GPS}, \text{ then } LU_{WP(N)} \text{ is set to } 3*\sigma\text{GPS} \quad \text{(Eq. 12)}$$

As can be seen by the low limit check of Equations 11 and 12, the GPS tracking error terms only correct the location and the uncertainty when the uncertainty is greater than the current GPS uncertainty (differential or non-differential). The uncertainty widow values are set to their lower limits in Equations 11 and 12.

If the slip/slide conditions are continuous for more than 30 seconds, then the LDS 100 is profiled to a stop for location reset to the GPS location projected on the track 101.

For zero speeds, the location uncertainty (qualifying) window returns to the GPS uncertainty and the location estimate returns to the GPS position. The effect of the lower limit on the uncertainty window, and the accuracy of the GPS and the location update of Equations 6 and 7 cause these results.

During movement, three times the GPS uncertainty is the lower limit of the location estimate uncertainty. When the railroad vehicle 111 is moving, the location estimate uncertainty window will always be greater than or equal to three times the GPS uncertainty.

The location estimate is initialized to the first GPS location that is within $3\sigma_{GPS}$ of the track 101. The location is initialized to the first GPS position that is near the track map 108. The reading is skipped if it is further than 3 sigma away from the track map 108.

Figure 5:
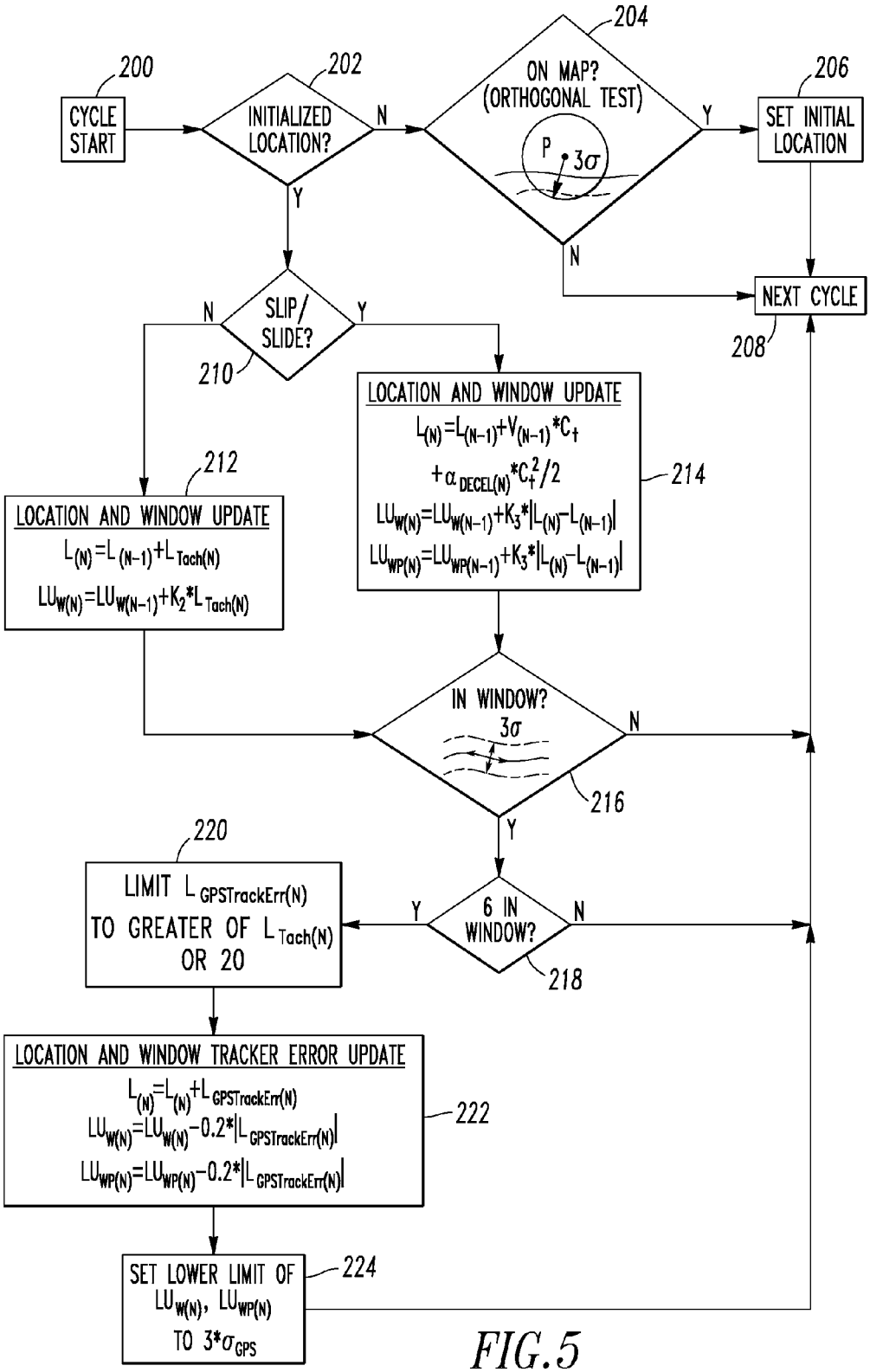
FIG. 5 is a flowchart of a portion of the routine of FIG. 2.

FIG. 5 shows a routine for determining the location and the location uncertainly windows for both non-slide (i.e., non-slip/slide) and slide (i.e., slip/slide) conditions. A cycle starts, at 200, after which, at 202, it is determined if the location $L_{(N)}$ has been initialized. If not, then it is determined, at 204, if the GPS data 144 is within $3\sigma$ as measured orthogonal to the track map 108 (FIG. 2). If so, then the initial location is set, at 206, using the GPS data 144. Otherwise, the routine exits to await the next cycle, at 208.

On the other hand, if the location L(N) was previously initialized, as determined at 202, then it is determined if there is a slip/slide condition, at 210, as per Equation 3. If not, then, at 212, the location estimate $L_{(N)}$ and the location uncertainty window $LU_{W(N)}$ are updated per Equations 6 (ignoring, for the moment, the GPS tracking error 107 of Equation 1A) and 8A, respectively. Otherwise, if there is a slip/slide condition, then the location estimate $L_{(N)}$ and the location uncertainty windows $LU_{W(N)}$ and $LU_{WP(N)}$ are updated per Equations 7 (ignoring, for the moment, the GPS tracking error 107 of Equation 1A) and 8B-8C, respectively.

After either 212 or 214, it is determined, at 216, if the GPS data 144 is within the windows 111A,111B of FIG. 3. If not, then the routine exits to await the next cycle, at 208. Otherwise, at 218, it is determined if the GPS data 144 (FIG. 2) has been within the windows 111A,111B for six consecutive cycles. If not, then the routine exits to await the next cycle, at 208. Otherwise, at 220, the GPS tracking error 107 of Equation 1A is calculated and limited, if needed, per Equation 2.

Next, at 222, the location estimate $L_{(N)}$ is updated with the (limited) GPS tracking error 107 of Equations 1A and 2 per Equation 6. Also, the location uncertainty windows $LU_{W(N)}$ and $LU_{WP(N)}$ are updated with the (limited) GPS tracking error 107 of Equations 1A and 2 per Equations 9 and 10, respectively.

Finally, at 224, the location uncertainty windows $LU_{W(N)}$ and $LU_{WP(N)}$ are adjusted, if needed, to be at least the lower limit of $3\sigma_{GPS}$, after which the routine exits to await the next cycle, at 208.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A system for determining location and location uncertainty of a railroad vehicle, said system comprising:

a global positioning system receiver structured to determine position of said railroad vehicle;

a predetermined track map of possible coordinates of said railroad vehicle;

a plurality of motion sensors structured to determine change in location of said railroad vehicle, said motion sensors being biased to provide a positive bias error of said change in location of said railroad vehicle;

an acceleration sensor structured to determine acceleration of said railroad vehicle; and a processor cooperating with said global positioning system receiver, said predetermined track map, said motion sensors and said acceleration sensor to vitally determine the location and the location uncertainty of said railroad vehicle on said predetermined track map, said processor being structured to verify one of said motion sensors with another one of said motion sensors, determine a slip or slide condition of said railroad vehicle from said one of said motion sensors, determine speed and position of said railroad vehicle from said acceleration sensor during said slip or slide condition, verify the position of said railroad vehicle from said global positioning system receiver based upon said predetermined track map, and correct the positive bias error of said one of said motion sensors using the position of said railroad vehicle from said global positioning system receiver.

2. The system of claim 1 wherein said motion sensors are tachometers.

3. The system of claim 1 wherein said acceleration sensor is an accelerometer.

4. The system of claim 1 wherein said processor is further structured to determine an initial position of said railroad vehicle from the position of said railroad vehicle from said global positioning system receiver.

5. The system of claim 4 wherein said track map includes a representation of a track for said railroad vehicle; wherein the position of said railroad vehicle from said global positioning system receiver has an uncertainty; wherein said processor is further structured to determine if the position of said railroad vehicle from said global positioning system receiver as measured orthogonal to said representation of a track is within three times said uncertainty before said processor determines the initial position of said railroad vehicle.

6. The system of claim 1 wherein said processor is further structured to determine the location and the velocity of said railroad vehicle in each of a plurality of periodic cycles; wherein said periodic cycles have a cycle time; and wherein when said processor determines said slip or slide condition of said railroad vehicle for the current one of said periodic cycles, said processor is further structured to determine the location of said railroad vehicle for the current one of said periodic cycles from the sum of: (a) the location of said railroad vehicle for the previous one of said periodic cycles, (b) the velocity of said railroad vehicle for the previous one of said periodic cycles times said cycle time, and (c) the square of said cycle time times the acceleration of said railroad vehicle from said acceleration sensor divided by two.

7. The system of claim 6 wherein said processor is further structured to determine the location uncertainty of said railroad vehicle in each of said periodic cycles; and wherein said processor is further structured to determine the location uncertainty of said railroad vehicle for the current one of said periodic cycles from the sum of: (a) the location uncertainty of said railroad vehicle for the previous one of said periodic cycles, and (b) a predetermined constant times the absolute value of the difference of: (i) the location of said railroad vehicle for the current one of said periodic cycles, and (ii) the location of said railroad vehicle for the previous one of said periodic cycles.

8. The system of claim 7 wherein said predetermined constant is 0.05.

9. The system of claim 1 wherein said processor is further structured to determine the location and the velocity of said railroad vehicle in each of a plurality of periodic cycles; wherein said periodic cycles have a cycle time; and wherein when said processor determines there is no said slip or slide condition of said railroad vehicle for the current one of said periodic cycles, said processor is further structured to determine the location of said railroad vehicle for the current one of said periodic cycles from the sum of: (a) the location of said railroad vehicle for the previous one of said periodic cycles, and (b) the change in location of said railroad vehicle from said one of said motion sensors.

10. The system of claim 9 wherein said processor is further structured to determine the location uncertainty of said railroad vehicle in each of said periodic cycles; and wherein said processor is further structured to determine the location uncertainty of said railroad vehicle for the current one of said periodic cycles from the sum of: (a) the location uncertainty of said railroad vehicle for the previous one of said periodic cycles, and (b) a predetermined constant times the change in location of said railroad vehicle from said one of said motion sensors.

11. The system of claim 10 wherein said predetermined constant is 0.015.

12. The system of claim 1 wherein said processor is further structured to determine the location and the location uncertainty of said railroad vehicle in each of a plurality of periodic cycles.

13. The system of claim 12 wherein said periodic cycles have a cycle time of about one second.

14. The system of claim 12 wherein said processor is further structured to determine a tracking error from the difference between: (a) the position of said railroad vehicle from said global positioning system receiver for the current one of said periodic cycles, and (b) the location of said railroad vehicle for the previous one of said periodic cycles.

15. The system of claim 14 wherein said processor is further structured to determine the location uncertainty of said railroad vehicle in each of said periodic cycles; wherein said processor is further structured to determine the location uncertainty of said railroad vehicle for the current one of said periodic cycles from the sum of: (a) the location uncertainty of said railroad vehicle for the previous one of said periodic cycles, and (b) a predetermined constant times the absolute value of the difference of: (i) the location of said railroad vehicle for the current one of said periodic cycles, and (ii) the location of said railroad vehicle for the previous one of said periodic cycles; wherein said track map includes a representation of a track for said railroad vehicle; wherein the position of said railroad vehicle from said global positioning system receiver has an uncertainty; wherein said processor is further structured to determine said tracking error only after the position of said railroad vehicle from said global positioning system receiver for a consecutive plurality of said periodic cycles satisfies both of: (a) a first condition defined by the position of said railroad vehicle from said global positioning system receiver as projected on said representation of a track being within: (i) a lower limit of the location of said railroad vehicle for the previous one of said periodic cycles minus the location uncertainty of said railroad vehicle for the current one of said periodic cycles, and (ii) an upper limit of the location of said railroad vehicle for the previous one of said periodic cycles plus three times said uncertainty of said global positioning system receiver along said representation of a track, and (b) a second condition defined by the position of said railroad vehicle from said global positioning system receiver as measured orthogonal to said representation of a track being within: (i) a lower limit of the location of said railroad vehicle for the previous one of said periodic cycles minus three times said uncertainty of said global positioning system receiver, and (ii) an upper limit of the location of said railroad vehicle for the previous one of said periodic cycles plus three times said uncertainty of said global positioning system receiver.

16. The system of claim 14 wherein said processor is further structured to determine the location uncertainty of said railroad vehicle in each of said periodic cycles; wherein said processor is further structured to determine the location uncertainty of said railroad vehicle for the current one of said periodic cycles from the sum of: (a) the location uncertainty of said railroad vehicle for the previous one of said periodic cycles, and (b) a predetermined constant times the change in location of said railroad vehicle from said one of said motion sensors; wherein said track map includes a representation of a track for said railroad vehicle; wherein the position of said railroad vehicle from said global positioning system receiver has an uncertainty; wherein said processor is further structured to determine said tracking error only after the position of said railroad vehicle from said global positioning system receiver for a consecutive plurality of said periodic cycles satisfies both of: (a) a first condition defined by the position of said railroad vehicle from said global positioning system receiver as projected on said representation of a track being within: (i) a lower limit of the location of said railroad vehicle for the previous one of said periodic cycles minus the location uncertainty of said railroad vehicle for the current one of said periodic cycles, and (ii) an upper limit of the location of said railroad vehicle for the previous one of said periodic cycles plus three times said uncertainty of said global positioning system receiver along said representation of a track, and (b) a second condition defined by the position of said railroad vehicle from said global positioning system receiver as measured orthogonal to said representation of a track being within: (i) a lower limit of the location of said railroad vehicle for the previous one of said periodic cycles minus three times said uncertainty of said global positioning system receiver, and (ii) an upper limit of the location of said railroad vehicle for the previous one of said periodic cycles plus three times said uncertainty of said global positioning system receiver.

17. The system of claim 16 wherein said consecutive plurality of said periodic cycles is a consecutive six of said periodic cycles.

18. The system of claim 16 wherein said processor is further structured to set said tracking error to zero if both of said first and second conditions are not satisfied.

19. The system of claim 16 wherein said processor is further structured to limit the magnitude of said tracking error to be less than or equal to the larger of: (a) the change in location of said railroad vehicle from said one of said motion sensors, and (b) a predetermined value.

20. The system of claim 19 wherein said predetermined value is twenty feet for each of said periodic cycles.

21. The system of claim 16 wherein when said processor determines there is no said slip or slide condition of said railroad vehicle for the current one of said periodic cycles, said processor is further structured to determine the location of said railroad vehicle for the current one of said periodic cycles from the sum of: (a) the location of said railroad vehicle for the previous one of said periodic cycles, (b) the change in location of said railroad vehicle from said one of said motion sensors, and (c) said tracking error.

22. The system of claim 21 wherein said one of said motion sensors accumulates a distance error caused by said positive bias error; and wherein said tracking error collapses said accumulated distance error to three times the uncertainty of said global positioning system receiver.

23. The system of claim 16 wherein when said processor determines there is no said slip or slide condition of said railroad vehicle for the current one of said periodic cycles, said processor is further structured to adjust the location uncertainty of said railroad vehicle for the current one of said periodic cycles by a predetermined constant times the absolute value of said tracking error.

24. The system of claim 23 wherein said predetermined constant is −0.2.

25. The system of claim 23 wherein the location uncertainty of said railroad vehicle for the current one of said periodic cycles is limited to be the minimum of three times said uncertainty of said global positioning system receiver.

26. The system of claim 16 wherein the position of said railroad vehicle from said global positioning system receiver is ignored if both of said first and second conditions are not satisfied.

27. The system of claim 1 wherein said system is a positive train control system.

* * * * *

UNITED STATES PATENT AND TRADEMARK OFFICE

CERTIFICATE OF CORRECTION

PATENT NO. : 7,966,126 B2
APPLICATION NO. : 12/031779
DATED : June 21, 2011
INVENTOR(S) : Sheldon G. Willis et al.

It is certified that error appears in the above-identified patent and that said Letters Patent is hereby corrected as shown below:

Column 9, line 59, "L_hd" should read --L--.
Column 9, line 59, "GPSTrackErr(N)" should read --$_{GPSTrackErr(N)}$--.
Column 11, line 24, "σGPS" should read --$\sigma_{GPS}$--.
Column 11, line 59, "L(N)" should read --$L_{(N)}$--.

Signed and Sealed this
Tenth Day of January, 2012

David J. Kappos

David J. Kappos
*Director of the United States Patent and Trademark Office*